US006647853B2

(12) United States Patent
Hickey

(10) Patent No.: US 6,647,853 B2
(45) Date of Patent: Nov. 18, 2003

(54) SEABED MINE CLEARANCE

(76) Inventor: Christopher Daniel Dowling Hickey, Jarretts Farm, Brantbridge Lane, Balcome, Haywards Heath, W. Sussex RH17 6JR (GB)

( * ) Notice: Subject to any disclaimer, the term of this patent is extended or adjusted under 35 U.S.C. 154(b) by 0 days.

(21) Appl. No.: 10/003,498

(22) Filed: Nov. 1, 2001

(65) Prior Publication Data

US 2002/0129694 A1 Sep. 19, 2002

(30) Foreign Application Priority Data

Nov. 2, 2000 (GB) ..... 0026815

(51) Int. Cl.[7] ..... E02F 3/88
(52) U.S. Cl. ..... 89/1.13; 37/342; 37/344
(58) Field of Search ..... 89/1.13; 37/342, 37/344

(56) References Cited

U.S. PATENT DOCUMENTS

| | | | | | |
|---|---|---|---|---|---|
| 284,387 | A | * | 9/1883 | Cornelius et al. | |
| 294,303 | A | * | 2/1884 | Anderson | |
| 296,483 | A | * | 4/1884 | Stone | |
| 418,000 | A | * | 12/1889 | Fletcher | |
| 1,698,515 | A | * | 1/1929 | Stewart | |
| 3,019,535 | A | * | 2/1962 | Talbott et al. | |
| 3,187,447 | A | * | 6/1965 | Hollyoak | |
| 4,395,952 | A | | 8/1983 | Hickey | |
| 4,586,421 | A | | 5/1986 | Hickey et al. | |
| 4,819,347 | A | * | 4/1989 | Lofgren | 37/78 |
| 6,044,745 | A | | 4/2000 | Hickey | |

FOREIGN PATENT DOCUMENTS

| | | | | |
|---|---|---|---|---|
| DE | 40 10 686 A1 | | 10/1991 | |
| GB | 673535 | * | 6/1952 | 37/344 |
| GB | 0 222 805 B | | 3/1990 | |
| GB | 2 359 101 A | | 8/2001 | |
| IT | 446073 | * | 7/1950 | 37/344 |

* cited by examiner

*Primary Examiner*—Stephen M. Johnson
(74) *Attorney, Agent, or Firm*—Armstrong Teasdale LLP

(57) ABSTRACT

This disclosure relates to a vessel having means at the bow of the vessel to direct a water flow ahead of the vessel downwardly towards the sea bed in front of and to either side of the path of the vessel to displace material from the sea bed including any weapon system or obstacles on or buried in the sea bed away from the path of the vessel.

10 Claims, 8 Drawing Sheets

SEABED MINE CLEARANCE

CROSS REFERENCE TO RELATED APPLICATION

This application claims the benefit of United Kingdom Patent Application No. 0026815.1, filed Nov. 2, 2000.

BACKGROUND OF THE INVENTION

1. Field of the Invention

This invention relates to clearance of mines from the seabed and in particular from regions of the seabed close to the shoreline which have been mined to deter or prevent amphibious landings on the beach by amphibious landing craft.

2. Background of Prior Art

The problems of mine clearance of shallow water/beach areas for amphibious landings are well known. If it were possible for invaders to always have the choice of an ideal landing area, they would probably choose a comparatively gently sloping beach free from obstacles and composed of sand or shingle. The defenders will employ whatever defensive measures are open to them part of which will be the "surf zone" (SZ) which is suitable for "very shallow water mining" (VSWM). The deployment of a mix of comparatively small contact, pressure, and influence mines sown in the SZ and VSWM areas means that many will become buried by the action or tide and wave action. In fact some mines are deliberately shaped to aid the burying process. Any invader will therefore need to clear a safe passage through such areas in order for effective landings to take place. Current techniques which attempt to achieve the foregoing appear to be both expensive and time consuming to apply, embracing as they do the step by step procedures now applied, e.g.:

(a) first locate the mines then (b) neutralise or destroy them

The current means of implementing involve the use the highly expensive and complicated Mine Hunting Vessels (MHVs), robots, swimming teams and underwater vehicles, both manned and unmanned, and even in certain situations, trained dolphins.

SUMMARY OF THE INVENTION

It is now proposed that the means outlined in paragraphs (a) and (b) above should be dispensed with and in accordance with this invention, clearing the mines should be effected by directed large volumes of low velocity water at the seabed in a controlled manner, thereby clearing/excavating sand, shingle, cobbles and mines by rolling/water blasting them away, thus creating the safe passage needed.

Thus the invention provides a vessel having means at the bow of the vessel to direct a water flow ahead of the vessel downwardly towards the sea bed in front of and to either side of the path of the vessel to displace material from the sea bed including any weapon system or obstacles on or buried in the sea bed away from the path of the vessel.

The means for directing the water flow from the vessel will be referred to hereinafter as a water plough.

There are two main factors involved in achieving the foregoing:

(a) The effective clearance distance of the water

The distance at which the water, when discharged from the water plough, will effect the necessary scouring/clearing of the seabed, and therefore the objects embedded in it, e.g. stones, rocks, mines etc.

(b) The damage radius of the mine

The effective damage radius of any mine which may explode as they are being swept away. This will vary according to:

(i) the type and amount of explosive contained, and (ii) the depth of water in which it sits, e.g. in very shallow water the explosion will take the path of least resistance, and the direction will therefore mostly be towards the surface.

Clearance Distance of the Water

Devices already exist for which it is claimed that a six ft. diameter shrouded propeller, which requires 250–500 HP only can move seabed material at the following rates:

| Type of Soil | Movement $m^3$/hr | Rates Tons/hr |
|---|---|---|
| Loose Soils | | |
| Mobile Coarse Sand | 500–2000 | 1300–5200 |
| Dense Fine Sand | 250–750 | 650–1950 |
| Silt | 100–500 | 260–1300 |
| Gravel | 100–500 | 260–1300 |
| Cobbles/Rocks | 100–500 | 260–1300 |

This at a distance of some five to ten yards and furthermore clearing/excavating down to a depth of some 3 ft. or so, below the surface of the seabed.

Damage Radius of the Mine

The best information gathered so far, and this is very much 'rule of thumb' regarding the volume of influence of underwater explosions, is that a 1000 lbs charge has a damage radius of some 50 yds. Whilst the amount of explosive required to double the volume of influence can be:

(a) as high as 10 times the amount of explosive, or (b) as little as 4 times the amount However if it is accepted that 20 lbs of explosive (abut the charge in some anti invasion mines), would have a damage radius of say 10 to 12 yds, then a properly constructed Water Plough should be able to clear those mines, without its function being irreparably impaired, by those that do explode.

Providing Scouring Water

There are various ways in which the 'scouring water' action could be produced, ranging from:

(a) reversing the thrust from the ships propellers (b) by specially constructed ships, e.g. utilizing/directing the prop wash from say, bow thrusters, this by positioning devices to turn the prop wash through 90% so that it blows the clear path required ahead of the ship (c) by attaching a large fabricated intake to the bow of the ship, which accepts water and turns it through 90° to a narrowed projecting outlet thereby forcing a 'wave' ahead of the vessel and creating the necessary turbulence/scouring action (d) by the use of low pressure pumps with a large volumetric output (e) captive propellers in a 'caged enclosure', with power being supplied from the ships systems (f) by contra rotating paddles (g) using high speed water jets to product a Coanda effect to get the volume of water required flowing in the desired direction.

Water Plough Construction

The water plough should be constructed in such a manner, that the wave effect it produces should:

(a) create the scouring/cleaning effect at least 10 yds, ahead of its outlet, it should additionally (b) be constructed in flexible—resilient material, so designed as to direct the water flow in the desired direction but also to allow activation by a sensor which would react to the pressure impulse/shock wave created by an exploding mine and cause the Water Plough to:
(i) swing up
(ii) swing open—away
(iii) recoil, from the 'pressure' created (c) traverse through 180° around the bow of the vessel (d) be mounted on a boom (e.g. 90 ft in length), thereby sweeping a wide channel (of 180 ft for a 90 ft boom) as the vessel approaches the landing area.

BRIEF DESCRIPTION OF THE DRAWINGS

The following is a description of some specific embodiments of the invention, reference being made to the accompanying drawings in which.

DESCRIPTION OF THE PREFERRED EMBODIMENTS

Figure 1:
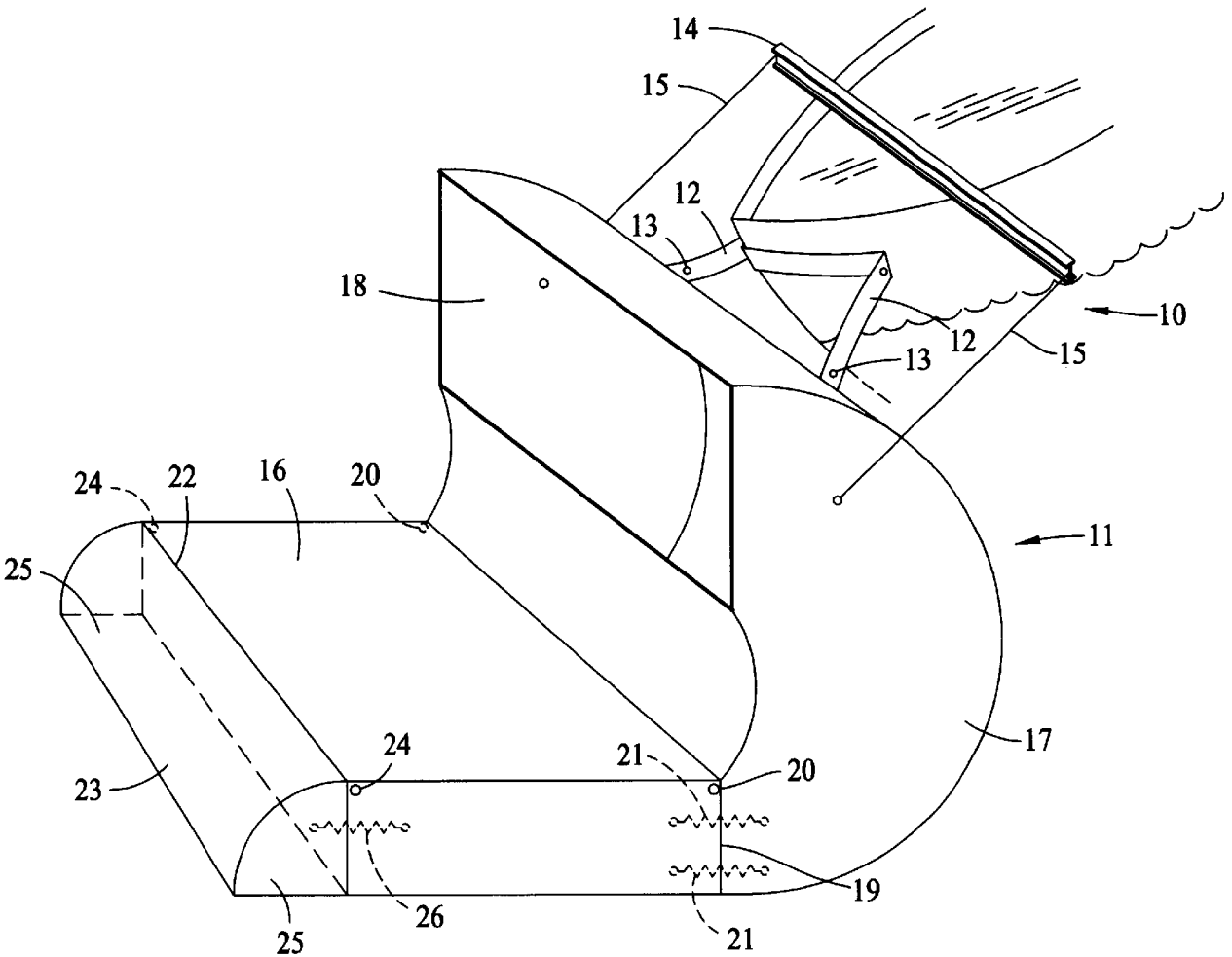
FIG. 1 shows the bow of a vessel and a water plough mounted on the bow of the vessel to provide a stream of water directed forwardly, downwardly and outwardly to either side of the vessel bow to clear mines buried in the seabed in the path of the vessel.
Figure 2:
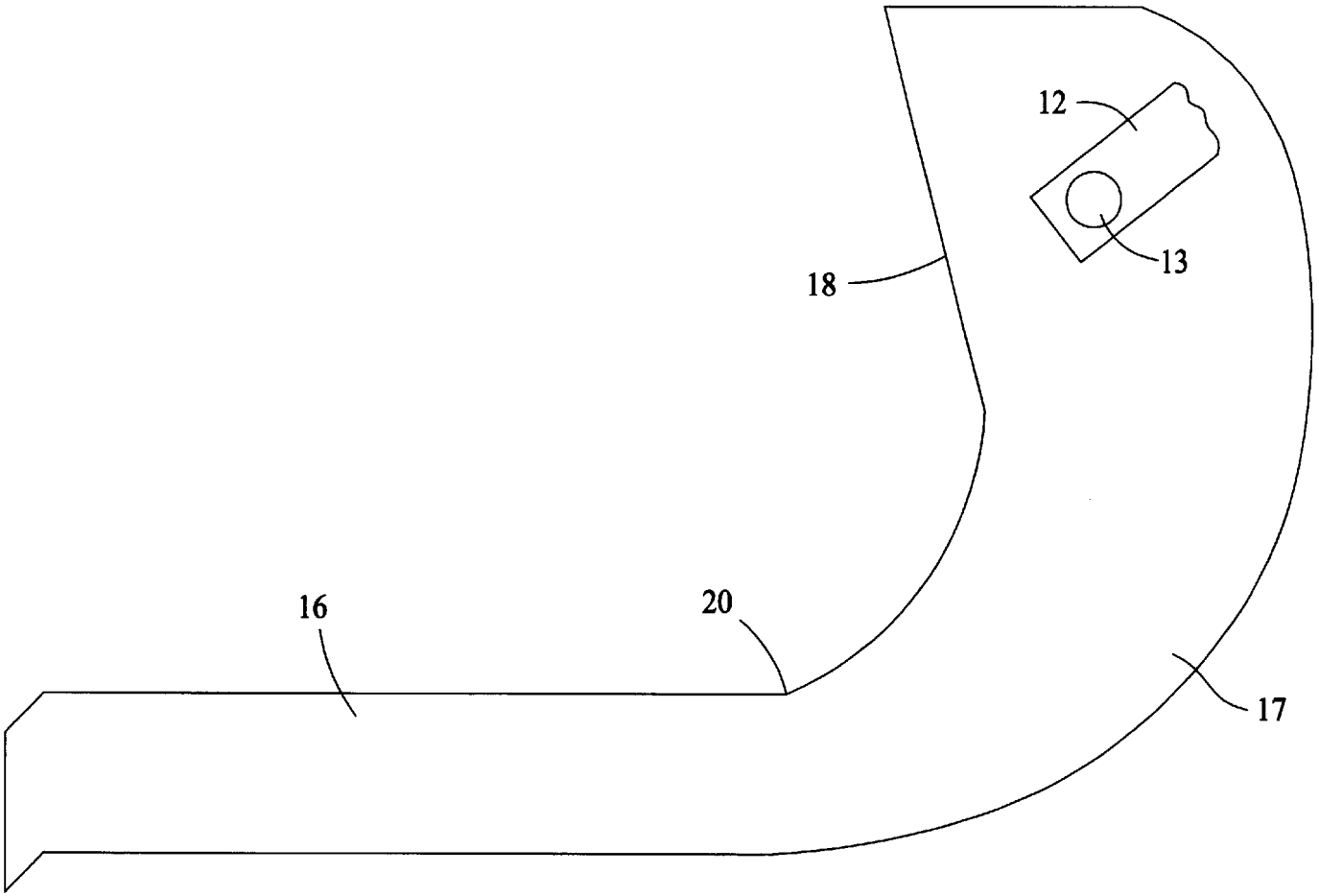
FIG. 2 is a side view of the water plough of FIG. 1.
Figure 3:
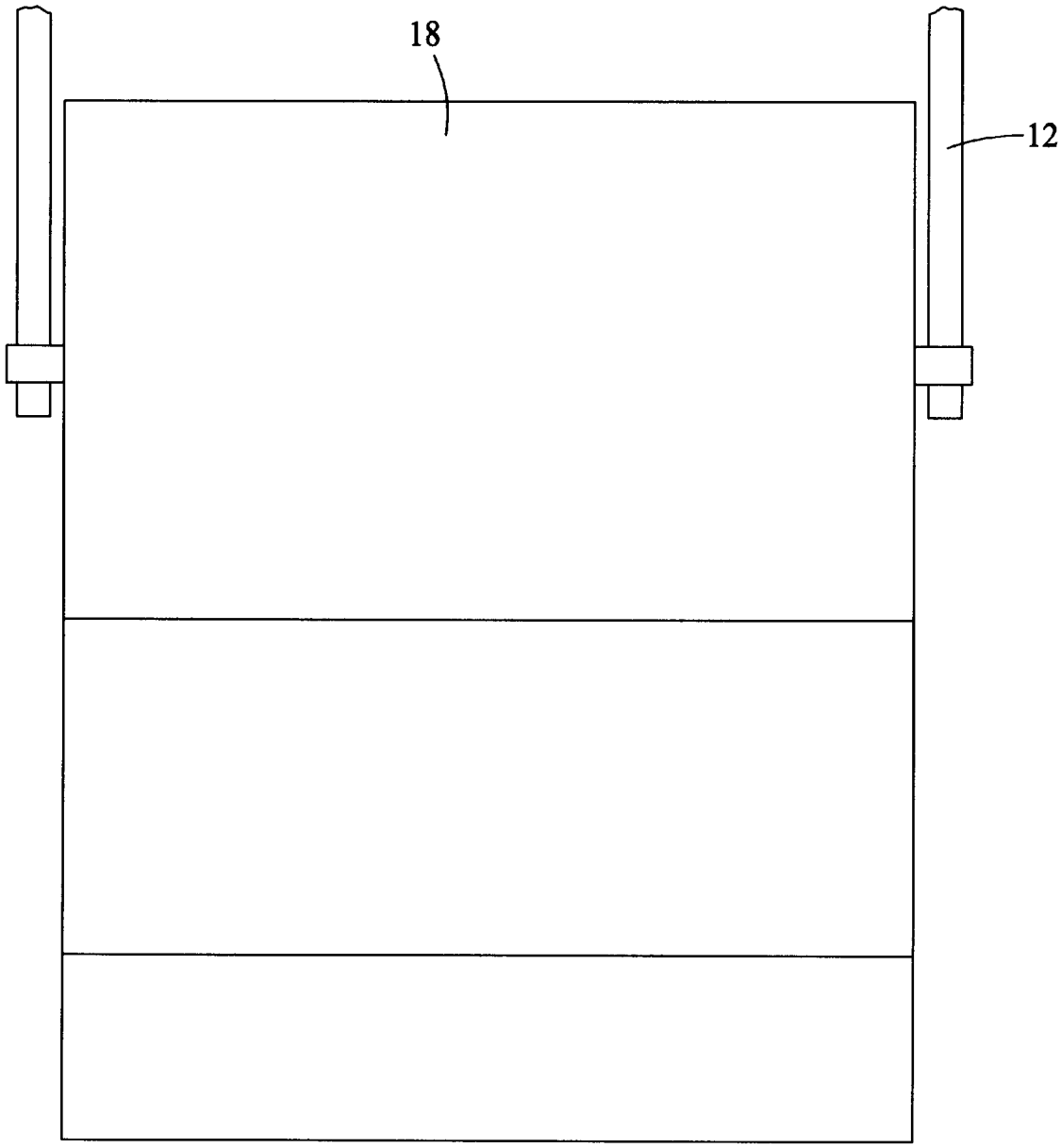
FIG. 3 is a front view of the water plough of FIG. 1.

References made firstly to the embodiments of FIGS. 1 to 3 of the drawings. In FIG. 1 there is shown a bow indicated generally at 10 of a ship on which a water plough indicated generally at 11 is mounted for providing a stream of water flowing forwardly, downwardly and outwardly to either side of the ships bow as the ship moves forwardly through the water to act on the seabed in the path of the ship to displace the material of the seabed and any mines buried or on the surface of the seabed outwardly away from the path of the ship to clear the seabed as it rises to the beach to provide a safe path for amphibious vehicles to land on the beach.

The vessel 10 has mounting arms 12 secured to either side of the bow which extend forwardly of the bow. Water plough 11 is hinged at 13 to the forwardly extending beams so that the water plough can pivot through an arc of movement about an axis extending transversely of the bow of the ship. The water plough is supported at a required orientation with respect to the bow by means of a cross-beam 14 mounted on the ships bow in which cables 15 extend forwardly and are attached to the water plough to support the water plough.

The water plough comprises a horizontally extending rectangular cross-section duct 16 extending forwardly of the ships bow. The duct 16 is pivoted at its rearward end to a semicircular inlet conduit 17 of similar rectangular cross-section to the duct. The conduit 17 has a forwardly facing open inlet 18 to receive a water flow as the vessel moves forwardly through the water and a lower outlet 19 in direct communication with the rearward end of the duct 16. As indicated above, the duct 16 is mounted on the inlet conduit 17 by means of pivotal mountings 20 at the top of the duct and powerful tension springs 21 extend between mountings on the duct 16 and inlet conduit 17 to hold the duct firmly in engagement with the conduit and the outlet from the conduit in register with the rearward end of the duct to deliver water received from the conduit into the duct.

At the forward end 22 of the duct an arcuate shaped discharge nozzle 23 is mounted by means of hinges 24 at the top of the duct. The arcuate discharge nozzle has a bottom outlet 25 to direct a downward flow of water from the duct against the seabed to churn up and discharge the material of the seabed and any mine laid on or in the seabed to either side of the path of the ship to clear the way for an amphibious vehicle to land on the beach.

The arcuate nozzle 23 is held positively in engagement with the duct 16 by powerful tension springs 26 attached to anchorages on the nozzle and duct.

Figure 4:
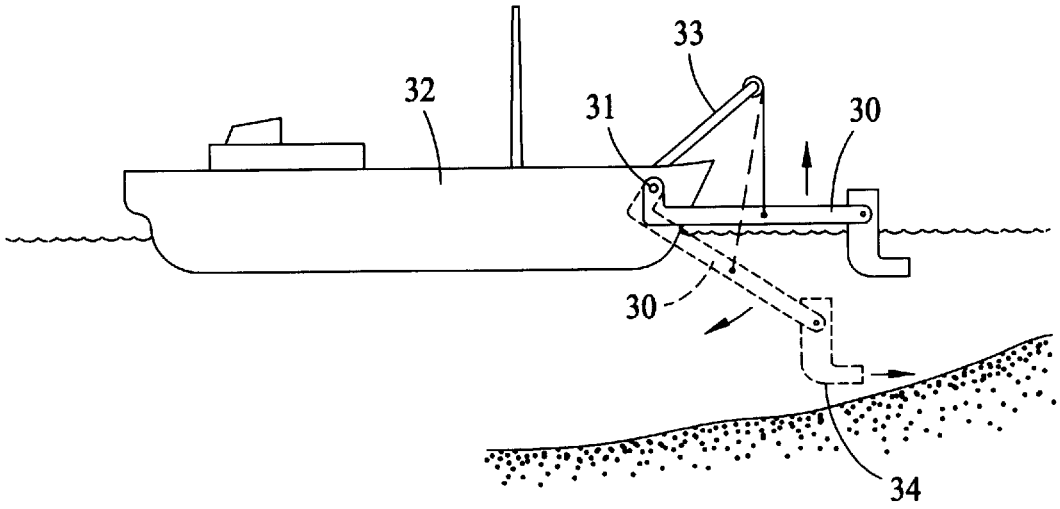
FIG. 4 shows an alternative construction of water plough mounted on a support boom extending forwardly from the bow of a vessel.
Figure 5:
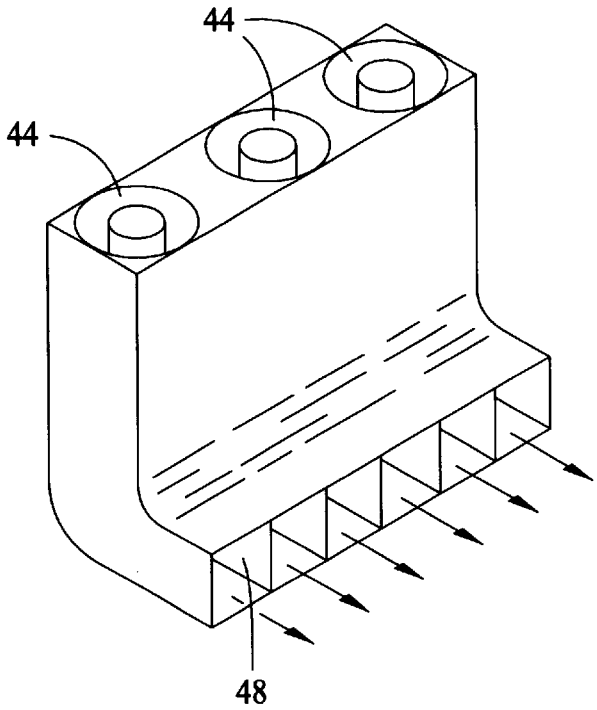
FIG. 5 is a perspective view of the water plough.
Figure 6:
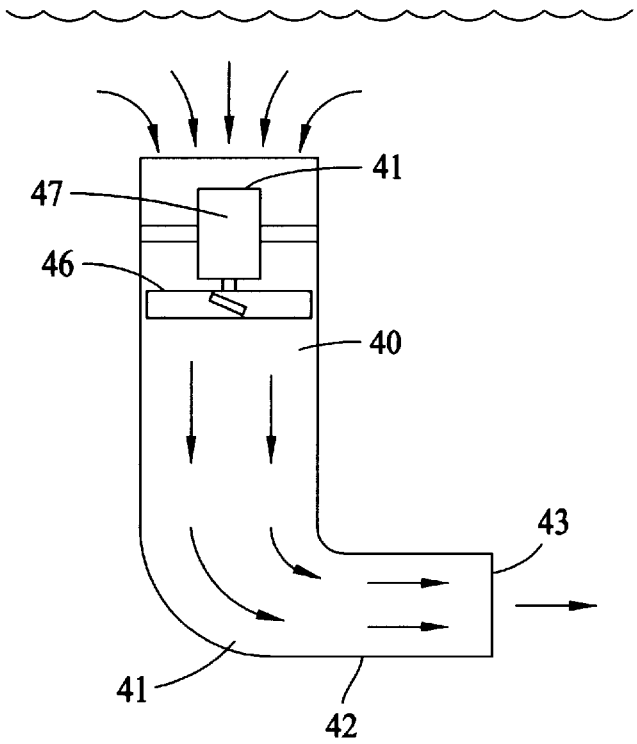
FIG. 6 is a cross-sectional view of the water plough of FIG. 4.

FIGS. 4 to 6 show a further arrangement of sea plough to which reference will now be made in this case the sea plough which again is indicated generally at 11 is pivotally mounted at the forward end of a boom structure 30 pivotally mounted at 31 on the bow of the vessel 32. A hoist 33 is mounted on the bow of the vessel and is connected to the boom structure at an intermediate location to raise and lower the boom structure as required. The sea plough 11 has a proximity sensor on its underside as indicated at 34 to detect when the bow is close to the seabed and to initiate control of the hoist mechanism to maintain the plough at a predetermined distance or within a predetermined range of heights above the seabed.

Reference is now made to FIGS. 5 and 6 which show the sea plough 11 in greater detail.

The sea plough is of elbow shaped form having an elongate rectangular cross-section, the elbow providing a vertical portion 14 having an open inlet 41 at its upper end, a 90° bend 41, a horizontal portion 42 and a forwardly facing outlet 43.

Three ducts 44 are mounted at spaces located across the inlet 41 as best seen in FIG. 5 and each duct contains a motor driven bladed impeller 46 having a drive motor 47 to draw water in through the inlet 41 and to discharge it downwardly through the duct and around the bend to the horizontal portion as indicated by the arrows and dense to emerge from the outlet 43 as a horizontal stream of water. The outlet 43 may be divided into separate sections by internal partitions 48 as indicated in FIG. 5.

The water plough therefore provides a forwardly directed stream of water to displace seabed material indicated in FIG. 4 in advance of the vessel away from the path of the vessel to provide a clear path for amphibious landing crafts over the seabed and onto the beach.

Figure 7:
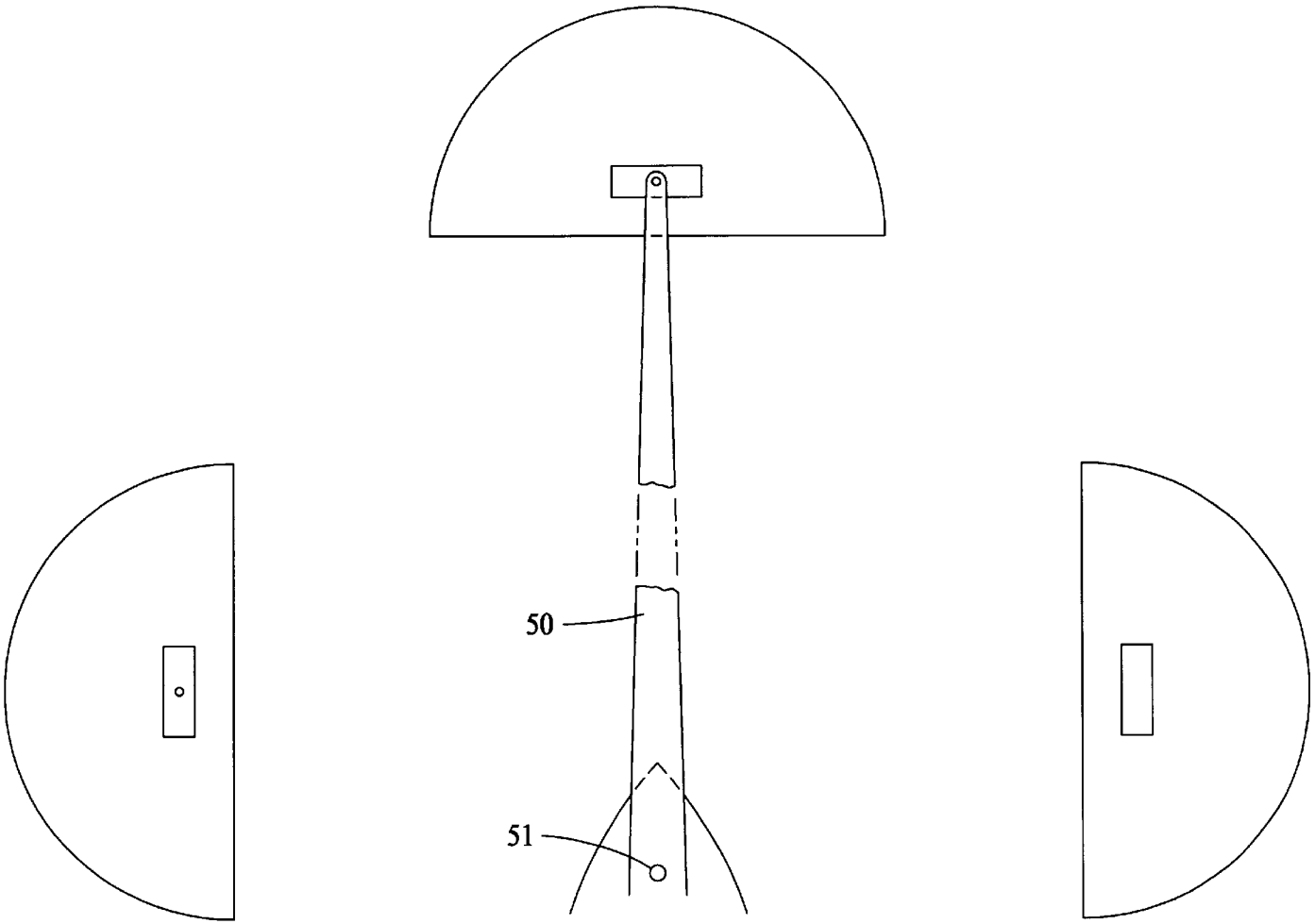
FIG. 7 is a plan view of the bow of a ship and water plough of FIGS. 4 to 6 having a modified form of boom mounting.

FIG. 7 shows a modified mounting for the sea plough of FIGS. 3 to 6 in which the boom 30 pivotally mounted on the horizontal axis to the bow of the vessel is replaced by a telescopic boom 50 mounted on the bow of the ship to rotate about a vertical axis 51 to enable the boom to be positioned directly forwardly of the vessel or to either side of the bow of the vessel. The water plough can therefore be used to displace seabed material ahead of the vessel when the boom is in its forwardly extending position or to either side of the vessel to sweep material from the path of the vessel.

Figure 8:
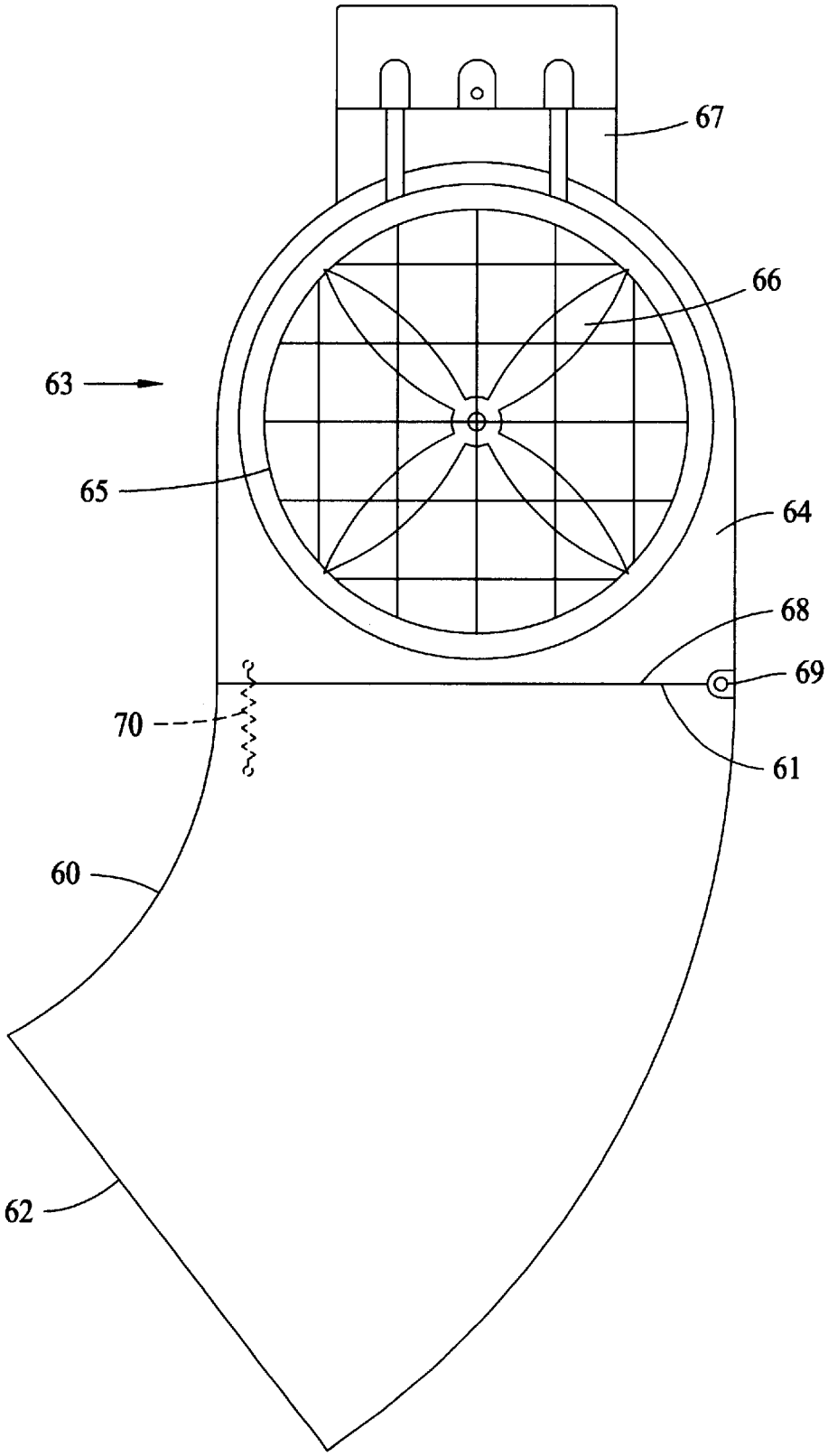
FIG. 8 is a side view of a further modified form of water plough.

FIG. 8 of the drawings shows a further form of plough comprising an arcuate duct 16 of rectangular cross-section having a vertically open inlet 61 and an downwardly angled outlet 62. An impeller system indicated generally at 63 is mounted on the inlet 61 and comprises a housing 64 having a horizontally open intake 65, a bladed impeller 66 mounted in the housing and driven by a motor unit 67 mounted on the housing. Water drawn in through the intake 65 is discharged through outlet 68 along the bottom of the housing which is in direct communication with the inlet 61 to the duct 60. The housing 64 is mounted on the duct by means of a hinge arrangement 69 along one edge of the housing and duct and by tension springs 70 extending between mounts at the opposite and of the duct and housing.

The water plough may be mounted on a boom on the prow of a ship as in the arrangement of FIG. 4 or the arrangement of FIG. 7.

Figure 9:
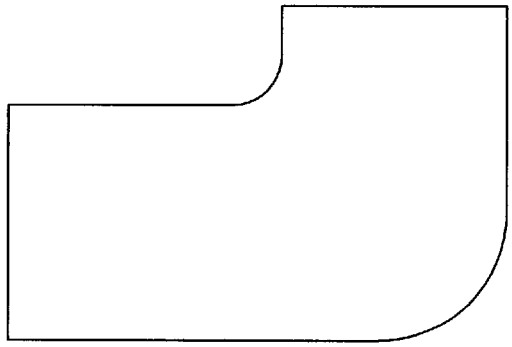
FIGS. 9 to 11 show an elbow conduit, on a ships bow over the outlet aperture from the conventional thruster in the bow to direct a stream of water forwardly, downwardly and outwardly of the bow.
Figure 10:
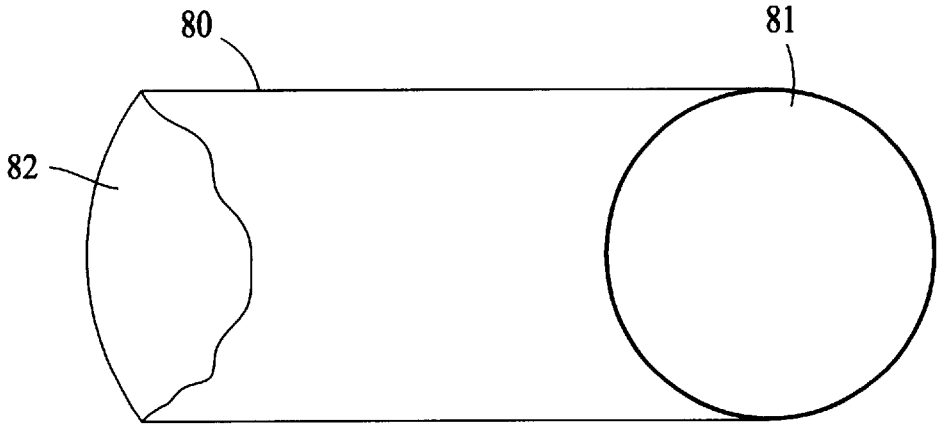
Figure 11:
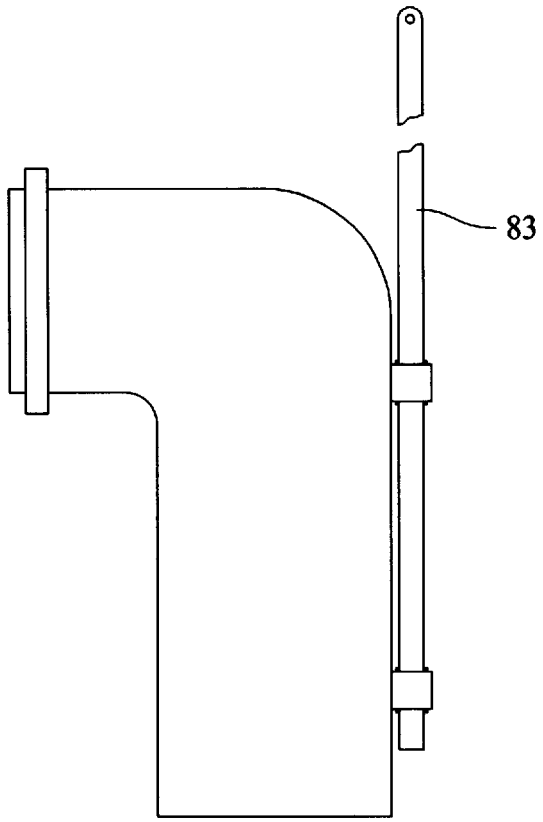

FIGS. 9 to 11 show an elbow duct 80 of circular cross-section having an inlet 81 and outlet 82. The duct is mounted on the discharge side of the bow thruster of a vessel to direct water from the thrust downwardly and outwardly of the bow of the vessel to displace material from the seabed outwardly away from the vessel as previously described. The ducts may be mounted on an arrangement of swinging support arms 83 mounted on the vessel bow as indicated at FIG. 11.

Other arrangements for displacing seabed material from the path of the vessel may include arrangements for making use of the wash produced by the vessels propulsion system.

What is claimed is:

1. A vessel having means at the bow of the vessel to direct a water flow ahead of the vessel to displace material away from the sea bed including any weapon system or obstacles on or buried in the sea bed away from the path of the vessel, wherein the means to direct water flow on the vessel comprise a duct mounted on the bow of the vessel, the duct being of rectangular cross-section and being of generally elbow shaped form having an upright portion with an inlet for water at its upper end, an arcuate portion sweeping forwardly of the vessel and an outlet facing forwardly and downwardly from the vessel and impeller means being provided in the duct adjacent the inlet to draw in water into the duct and discharge the water through the outlet from the duct in front of the path of the vessel to displace material from the sea bed including any weapon system or obstacles on or buried in the sea bed away from the path of the vessel.

2. A vessel as claimed in claim 1, wherein the duct has a vertically open inlet and one or more motor driven impellers are mounted in the inlet to draw in water through the inlet and discharge said water from the outlet.

3. A vessel as claimed in claim 2, wherein a plurality of motor driven impellers are mounted at spaced locations along the inlet to draw in water into the duct.

4. A vessel as claimed in claim 1, wherein the duct has a motor driven impeller mounted at the inlet end of the duct having a laterally facing opening to draw in water into the duct for discharge from the duct outlet.

5. A vessel as claimed in claim 1, wherein the duct is mounted on a boom extending forwardly from the vessel.

6. A vessel as claimed in claim 5, wherein the boom is pivotally mounted about a horizontal axis on the vessel and means are provided for raising and lowering the boom to maintain the duct at a preselected height above the seabed.

7. A vessel as claimed in claim 6, wherein a hoist is provided on the bow of the vessel to raise and lower the boom.

8. A vessel as claimed in claim 6, wherein a proximity sensor is provided on the duct to control the means for raising and lowering the boom to maintain the duct at a predetermined height above the seabed.

9. A vessel as claimed in claim 5, wherein the boom is mounted on the vessel to pivot about a vertical axis to extend forwardly or to either side of the vessel to displace the material of the seabed forwardly or to either side of the path of the vessel.

10. A vessel as claimed in claim 9, wherein means provided for rotating the duct with respect to the boom to determine the direction in which the water flow from the duct is discharged in relation to the fore and aft direction of the vessel.

* * * * *